US008596990B2

(12) United States Patent
Schaaf

(10) Patent No.: US 8,596,990 B2
(45) Date of Patent: Dec. 3, 2013

(54) PNEUMATIC VACUUM GENERATOR

(75) Inventor: Walter Schaaf, Freudenstadt-Gruental (DE)

(73) Assignee: J. Schmalz GmbH, Glatten (DE)

( * ) Notice: Subject to any disclaimer, the term of this patent is extended or adjusted under 35 U.S.C. 154(b) by 238 days.

(21) Appl. No.: 12/952,821

(22) Filed: Nov. 23, 2010

(65) Prior Publication Data

US 2011/0123359 A1 May 26, 2011

(30) Foreign Application Priority Data

Nov. 24, 2009 (DE) ..... 10 2009 047 085

(51) Int. Cl.
*F04F 5/00* (2006.01)

(52) U.S. Cl.
USPC ..... 417/151; 417/163; 417/171; 417/174

(58) Field of Classification Search
USPC ..... 417/151, 163, 171, 174, 360, 187
See application file for complete search history.

(56) References Cited

U.S. PATENT DOCUMENTS

| | | | | |
|---|---|---|---|---|
| 3,636,964 A | | 1/1972 | Colamussi et al. | |
| 3,942,724 A | | 3/1976 | Mocarski | |
| 4,395,202 A | * | 7/1983 | Tell | 417/169 |
| 4,960,364 A | * | 10/1990 | Tell | 417/174 |
| 5,205,717 A | | 4/1993 | Tell | |
| 5,228,839 A | * | 7/1993 | Peterson et al. | 417/174 |
| 6,171,068 B1 | * | 1/2001 | Greenberg | 417/174 |
| 6,296,454 B1 | * | 10/2001 | Schmid et al. | 417/151 |
| 6,354,371 B1 | * | 3/2002 | O'Blanc | 166/69 |
| 6,394,760 B1 | | 5/2002 | Tell | |
| 6,877,960 B1 | | 4/2005 | Presz, Jr. et al. | |
| 2004/0052646 A1 | | 3/2004 | Denoel et al. | |

FOREIGN PATENT DOCUMENTS

| | | | | |
|---|---|---|---|---|
| DE | 36 03 839 | C2 | | 9/1989 |
| DE | 44 91 977 | C1 | | 10/1994 |
| DE | 699 21 627 | T2 | | 9/1999 |
| DE | 20120138 | | * | 4/2002 |
| DE | 20120138 | U1 | | 4/2002 |
| EP | 0 142 424 | | | 5/1985 |
| EP | 0 650 456 | B1 | | 12/1996 |
| EP | 1 586 419 | B1 | | 9/2009 |
| WO | WO 99/49216 | | | 9/1999 |
| WO | WO 01/21961 | A1 | | 3/2001 |
| WO | WO 2006/011760 | A1 | | 2/2006 |
| WO | WO2009/054732 | | | 4/2009 |

* cited by examiner

*Primary Examiner* — Peter J Bertheaud
*Assistant Examiner* — Dominick L Plakkoottam
(74) *Attorney, Agent, or Firm* — Henry M. Feiereisen LLC

(57) ABSTRACT

A pneumatic vacuum generator includes at least one venturi nozzle having a flow cross section which deviates for a circularity. The venturi nozzle may thus have a substantial rectangular or non-circular flow cross section like for example an oval flow cross section or an elliptical flow cross section. At least two plates are disposed in parallel relationship and joined in sandwich construction, with one of the plates constructed to accommodate the venturi nozzle.

10 Claims, 7 Drawing Sheets

PNEUMATIC VACUUM GENERATOR

CROSS-REFERENCES TO RELATED APPLICATIONS

This application claims the priority of German Patent Application, Serial No. 10 2009 047 085.9, filed Nov. 24, 2009, pursuant to 35 U.S.C. 119(a)-(d), the content of which is incorporated herein by reference in its entirety as if fully set forth herein.

BACKGROUND OF THE INVENTION

The present invention relates to a pneumatic vacuum generator.

The following discussion of related art is provided to assist the reader in understanding the advantages of the invention, and is not to be construed as an admission that this related art is prior art to this invention.

Different kinds of vacuum generators are used to produce a negative pressure. In the field of automation, vacuum generators are used which generate a negative pressure using the Venturi principle. These vacuum generators are also called ejectors and require compressed air for building up the negative pressure. Prior art ejectors with cylindrical venturi nozzles or multistage ejectors with cylindrical venturi nozzles have been in use for some time. Also known are cylindrical transport ejectors that operate according to the Coanda principle and the planar Coanda principle.

U.S. Pat. No. 6,394,760 describes a multistage ejector, shown in more detail in FIG. 1*a*-1*d* and designated by reference numeral 10. The multistage ejector 10 has four suction stages 12, 14, 16, 18 with cylindrical venturi nozzles 20 to 26. FIGS. 1*a*-1*d* show schematically, in four cross-sectional views, the ejector 10 at gradually increased vacuum levels in a vacuum chamber 28 and overall decreasing vacuum flow. In FIG. 1*a* the ejector 10 is shown in a mode of operation in which compressed air is introduced in a direction of arrow 30 into the first venturi nozzle 20 so that air is drawn from the vacuum chamber 28 in a direction of arrow 32. Compressed air flows also through the venturi nozzle 22 so that air is drawn in a direction of arrow 34. The same happens also with respect to the venturi nozzles 24, 26 so that air is drawn in a direction of arrows 36, 38, respectively. Compressed air exits the multistage ejector 10 together with the aspirated air in a direction of arrow 40 through port 42. The total amount of suction air (arrows 44) enters the multistage ejector 10 via port 46. Flap valves 48, 50, 52 in the suction stages 14, 16, 18 are all open. As a result, the vacuum flow is high. FIG. 1*b* shows the multistage ejector 10 in an operating position in which the flap valve 52 is closed. When a particular negative pressure has been reached in the vacuum chamber 28, the flap valve 52 closes spontaneously so that suction air is drawn only via the suction stages 12, 14, 16 in the direction of arrows 32, 34, 36, respectively. As a result, the vacuum flow decreases while the negative pressure in the vacuum chamber increases. FIG. 1*c* shows the multistage ejector 10 in an operating position in which the flap valve 50 is closed as a result of the still higher negative pressure has been reached in the vacuum chamber 28. Thus, air is drawn only via the suction stages 12, 14 in the direction of arrows 32, 34, respectively. In FIG. 1*d*, also flap valve 48 closes as a result of a still higher negative pressure in the vacuum chamber 28, i.e. all flap valves 48, 50, 52 are now closed. Air is now drawn solely via the suction stage 12 in the direction of arrow 32. The vacuum flow is thus further decreased, indicated by the lesser number of arrows. On the other hand, a maximum negative pressure is generated in the vacuum chamber 28.

FIG. 2 shows a conventional multistage ejector 10*a* with three suction stages 12, 14, 16 and two flap valves 48, 50 which assume their closed positions. Parts corresponding with those in FIG. 1 are denoted by identical reference numerals and not explained again. Compressed air is introduced via two ports 54, whereas outgoing air exits through two ports 42 and one port 56, as indicated by the arrows. The mode of operation corresponds to the multistage ejector 10, as described with reference to FIGS. 1*a*-1*d*.

FIGS. 3*a* and 3*b* show by way of example a conventional Coanda ejector as disclosed in International application WO 2009/054732 A1 and designated by reference numeral 58. The Coanda ejector 58 is made in sandwich construction and includes a top plate 60, a bottom plate 62, and an intermediate plate 64. In FIG. 3*a*, the Coanda ejector 58 is of single-stage configuration, whereas in FIG. 3*b*, the Coanda ejector 58 has several parallel stages. In FIG. 3*a*, compressed air enters through port 54 in a direction of arrow 30 into the Coanda ejector 58 and is introduced tangentially via a channel 65 into a chamber 66. As a result, air is drawn in a direction of arrows 44 through a perforated inlet 46 in the bottom plate 62 and exits the chamber 66 together with compressed air via outlet channel 67. In the variation of FIG. 3*b*, compressed air is dispersed via a manifold 68 to several channels 65. Thus, compressed air is split over a total of six chambers 66. The bottom plate 62 has thus six inlets 46 to enable a gripping of a workpiece 70 over a large area.

A drawback common to all prior art vacuum generators or ejectors is their bulkiness.

It would therefore be desirable and advantageous to address this problem and to obviate other prior art shortcomings.

SUMMARY OF THE INVENTION

According to one aspect of the present invention, a pneumatic vacuum generator includes at least one venturi nozzle having a flow cross section which deviates from a circularity, and at least two plates disposed in parallel relationship and joined in sandwich construction, with one of the plates constructed to accommodate the venturi nozzle.

According to another advantageous feature of the present invention, the venturi nozzle may have substantial rectangular flow cross section or substantial non-circular cross section, e.g. oval flow cross section or elliptical flow cross section.

The present invention resolves prior art problems by providing a venturi nozzle with non-circular flow cross section. As a result, the planar venturi nozzle is compact and requires little installation space and may be constructed of multistage configuration. The flat structure of the vacuum generator allows the manufacture of the components from flat semifinished products so that production costs are reduced. The overall height is small so that the installation space is small as well. When combined with an area vacuum gripper, the vacuum generator can be best suited to the available space at hand.

Currently preferred is the provision of a vacuum generator with planar venturi nozzle with or without vacuum control, with the vacuum control having a vacuum sensor and a flap valve. Multistage ejectors with several planar venturi nozzles placed in series behind one another can also be realized. The flap valves can hereby be arranged perpendicular to the gripping area or in the gripping area, i.e. the flap is oriented parallel to the gripping area.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
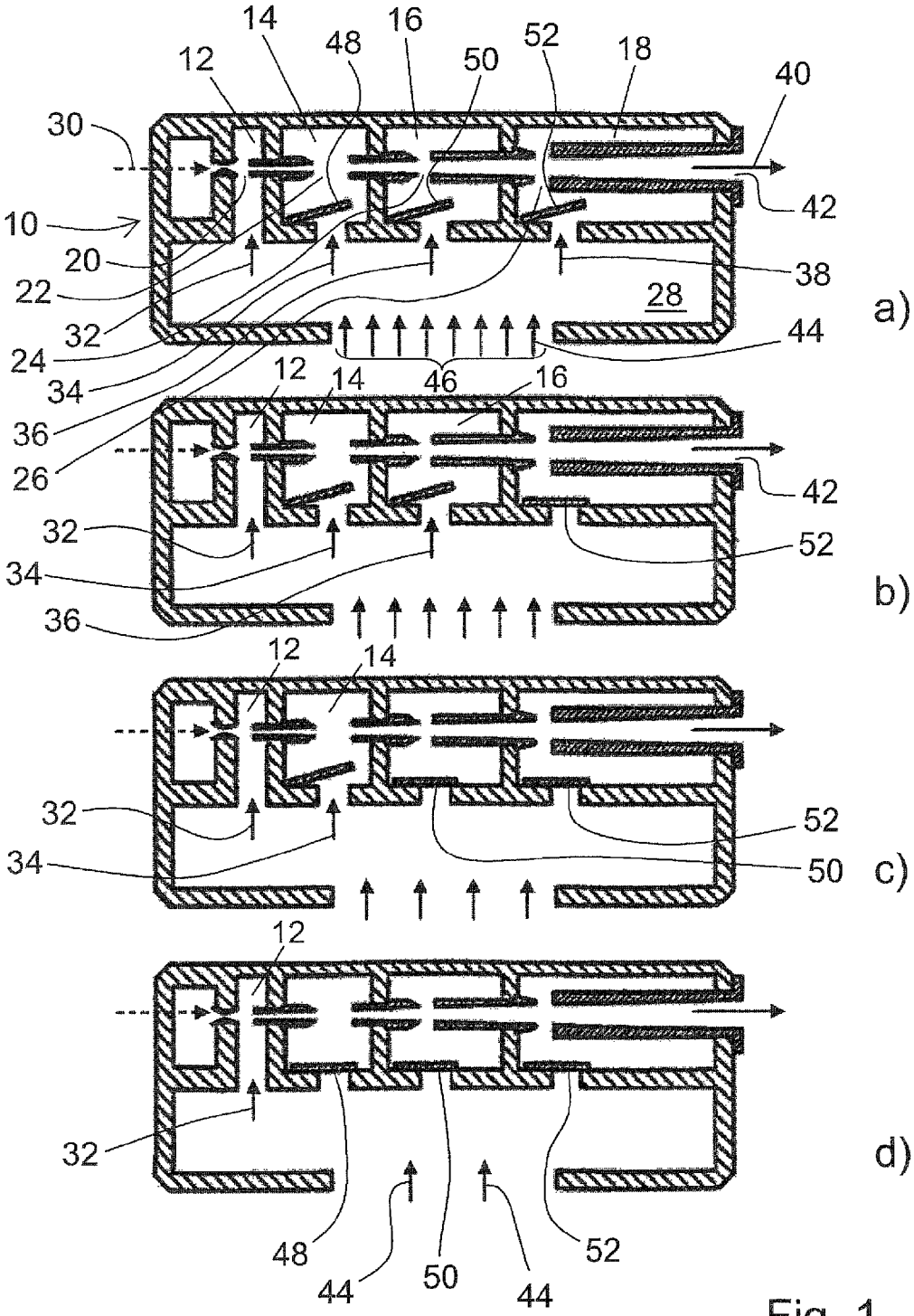
Fig. 1 Prior Art
FIGS. 1*a*-1*d* show schematic cross sectional views of a prior art multistage ejector with cylindrical venturi nozzles and illustration of increased vacuum levels over four suction stages in a vacuum chamber and overall decreasing vacuum flow.
Figure 2:
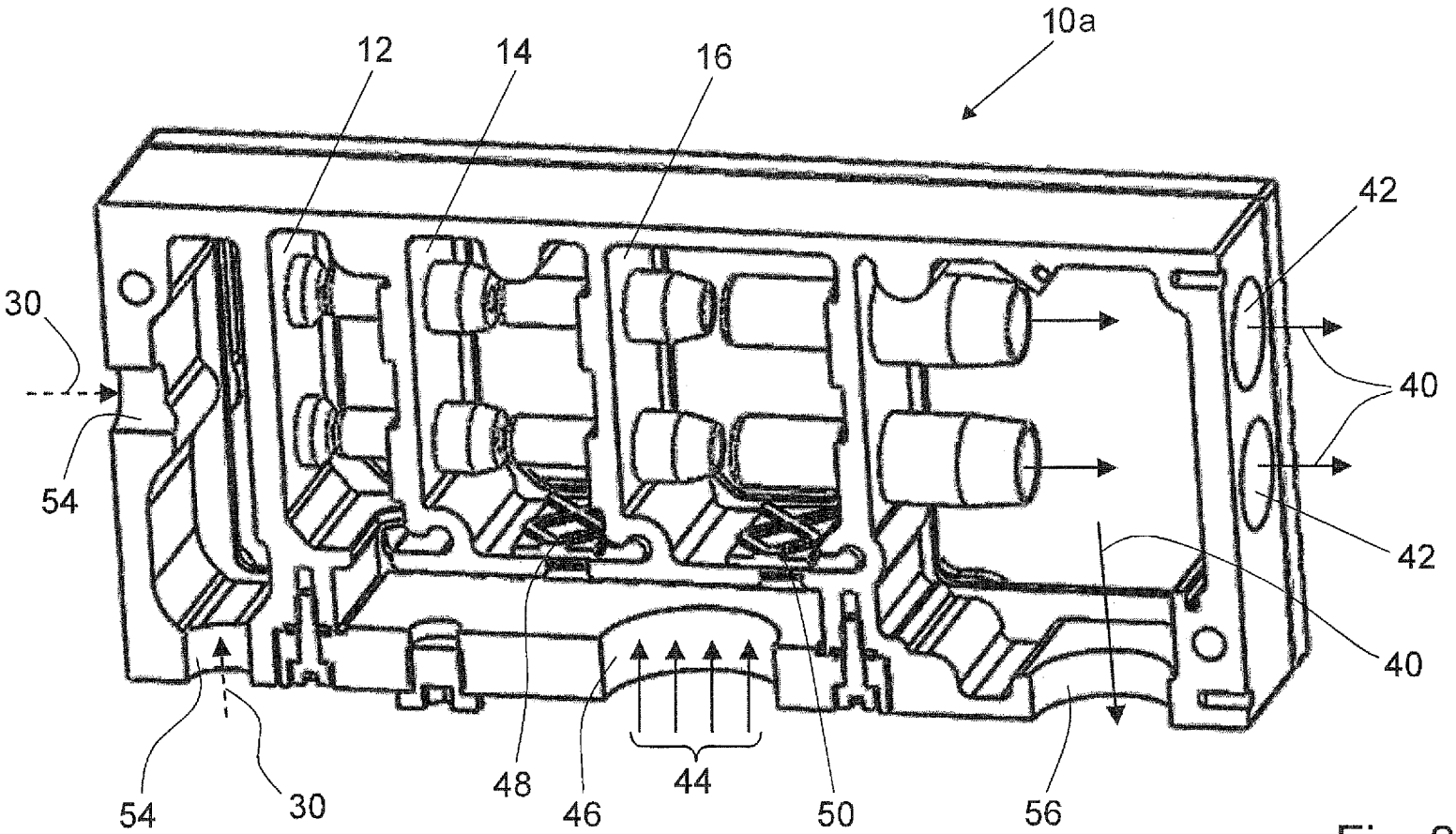
Fig. 2 Prior Art
FIG. 2 is a schematic illustration of a prior art multistage injector with cylindrical venturi nozzles, three suction stages and two flap valves, with both flap valves being closed.
Figure 3:
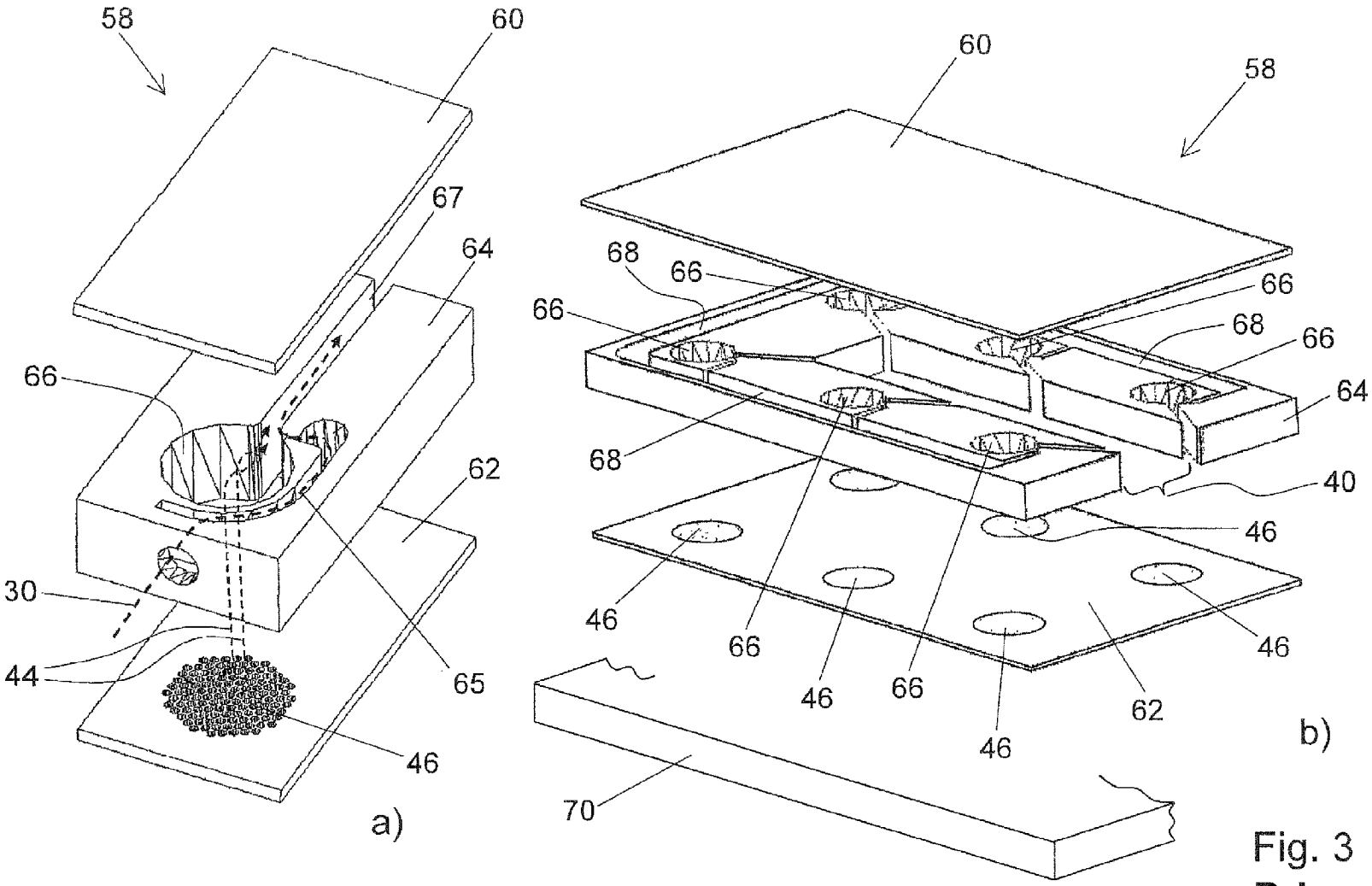
Fig. 3 Prior Art
FIGS. 3*a*-3*b* show exploded views of a prior art Coanda ejector.

Throughout all the figures, same or corresponding elements may generally be indicated by same reference numerals. These depicted embodiments are to be understood as illustrative of the invention and not as limiting in any way. It should also be understood that the figures are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Figure 4:
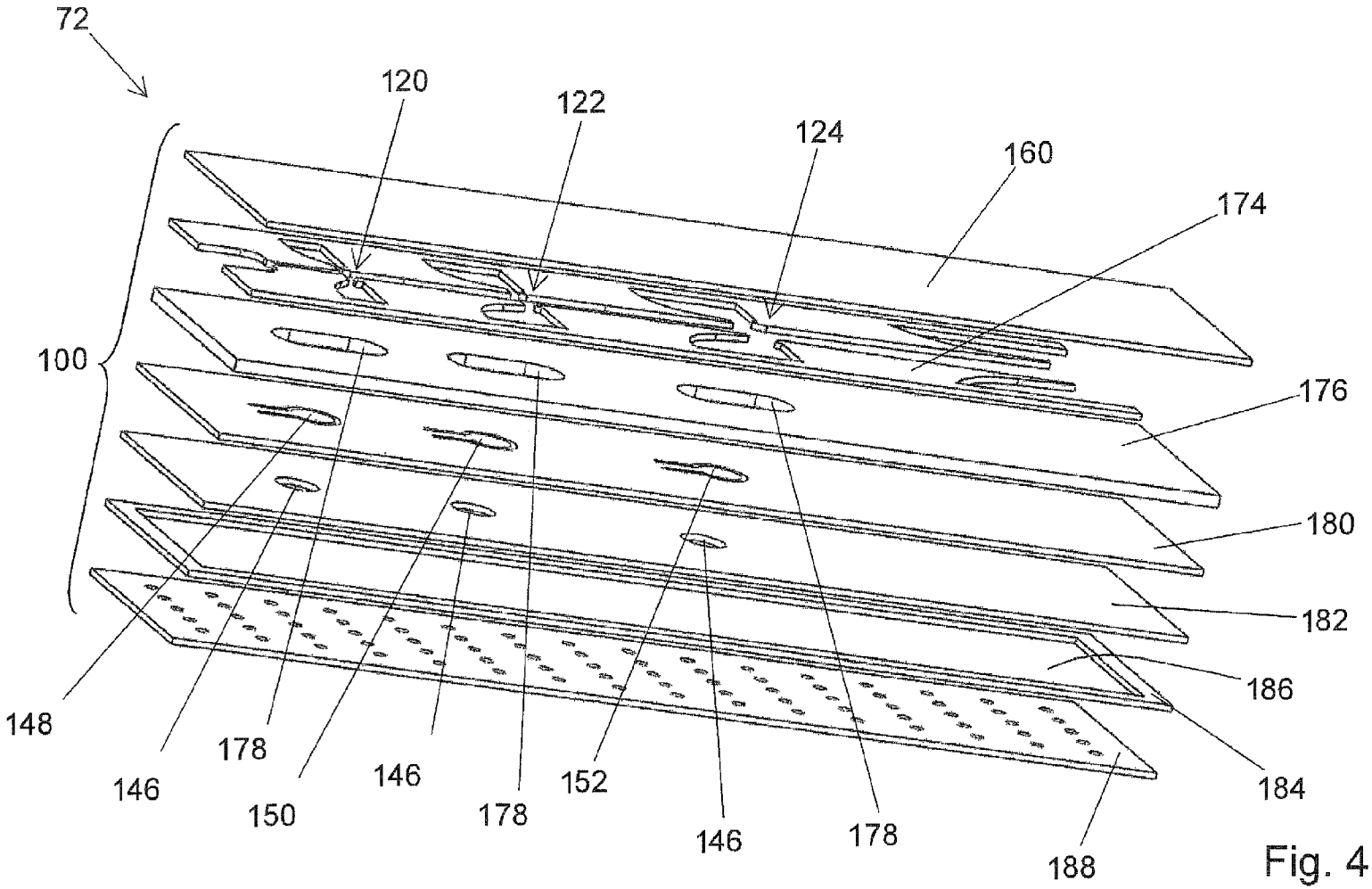
FIG. 4 is an exploded view of an area vacuum gripper having embodied therein a multistage ejector according to the present invention.

Turning now to the drawing, and in particular to FIG. 4, there is shown an exploded view of an area vacuum gripper generally designated by reference numeral 72 and having embodied therein a multistage ejector according to the present invention, generally designated by reference numeral 100. The multistage ejector 100 includes a nozzle plate 174 having planar venturi nozzles 120, 122, 124. Suction ports 146 and flap valves 148, 150, 152 are arranged in parallel relation to the venturi nozzles 120, 122, 124. The multistage ejector 100 is configured in sandwich construction and includes a top plate 160, the nozzle plate 174 disposed beneath the top plate 160, a support plate 176 placed beneath the nozzle plate 174 and formed with oblong openings 178 for support of the flap valves 148, 150, 152 which are received in a plate 180. The plate 180 can be made of any suitable material, e.g. elastomer and is provided with tongue-like or spoon-shaped valve tongues as a result of an omega-shaped (Ω-shaped) section line. Placed underneath the plate 180 is a plate 182 having suction ports, with a frame 184 abutting the underside of the plate 182 and configured to form a suction chamber 186 between the plate 182 and a perforated plate 188. The plates 160, 174, 176, 180, 182, 188 can be made of any suitable material, e.g. metal, and the frame 184 can be made of metal or a sealing material of plastic. All plates may be punched or laser cut. The plates may also be cut by water jet application or by using coated EDM wires to prevent the formation or burrs.

Figure 5:
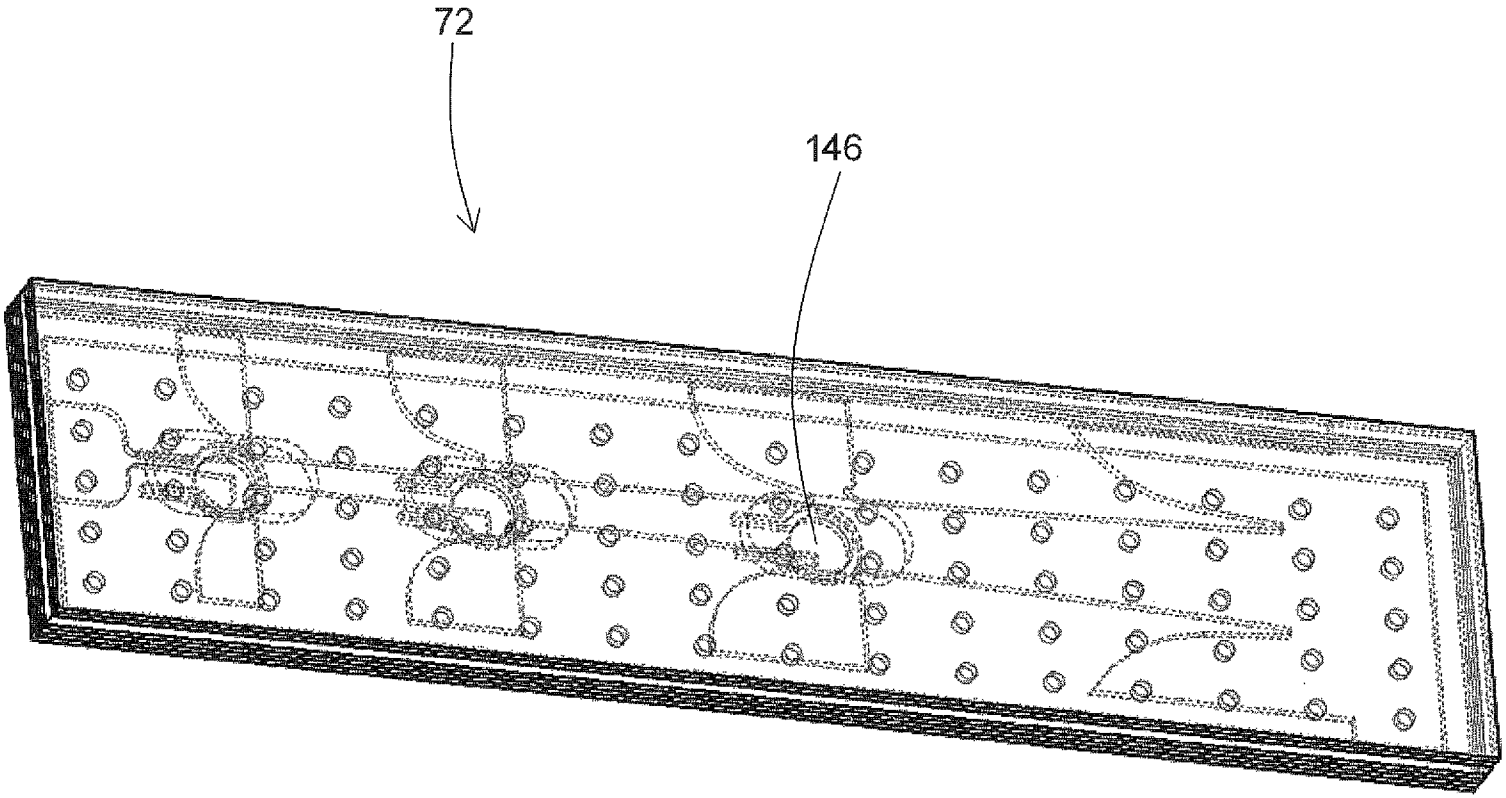
FIG. 5 is a schematic illustration of the area vacuum gripper of FIG. 4 in assembled state.

When the multistage ejector 10 with the planar venturi nozzles 120, 122, 124, and with the suction ports 146 and flap valves 148, 150, 152 which are arranged in parallel relation to the plane of the venturi nozzles 120, 122, 124, is assembled, the vacuum gripper 72 has a slender structure of slight height, as can be seen from FIG. 5. The rectangular cross section of the venturi nozzles 120, 122, 124 is rendered possible by covering the nozzle plate 74 with simple boards.

The mode of operation of the vacuum gripper 72 is known to the artisan and follows essentially the mode of operation as described above with reference to FIGS. 1*a*-1*d*, so that further description is not necessary. For example, outgoing air flow from an outlet of the (upstream) venturi nozzle 120 constitutes a propellant air flow for an inlet of the (downstream) venturi nozzle 122, whereas outgoing air flow from an outlet of the venturi nozzle 122 constitutes a propellant air flow for an inlet of the still further downstream venturi nozzle 124. The flow cross section of the venturi nozzles 120, 122, 124 increases in flow direction of introduced compressed air. Currently preferred is a configuration of the venturi nozzles 120, 122, 124 with rectangular housing.

Figure 6:
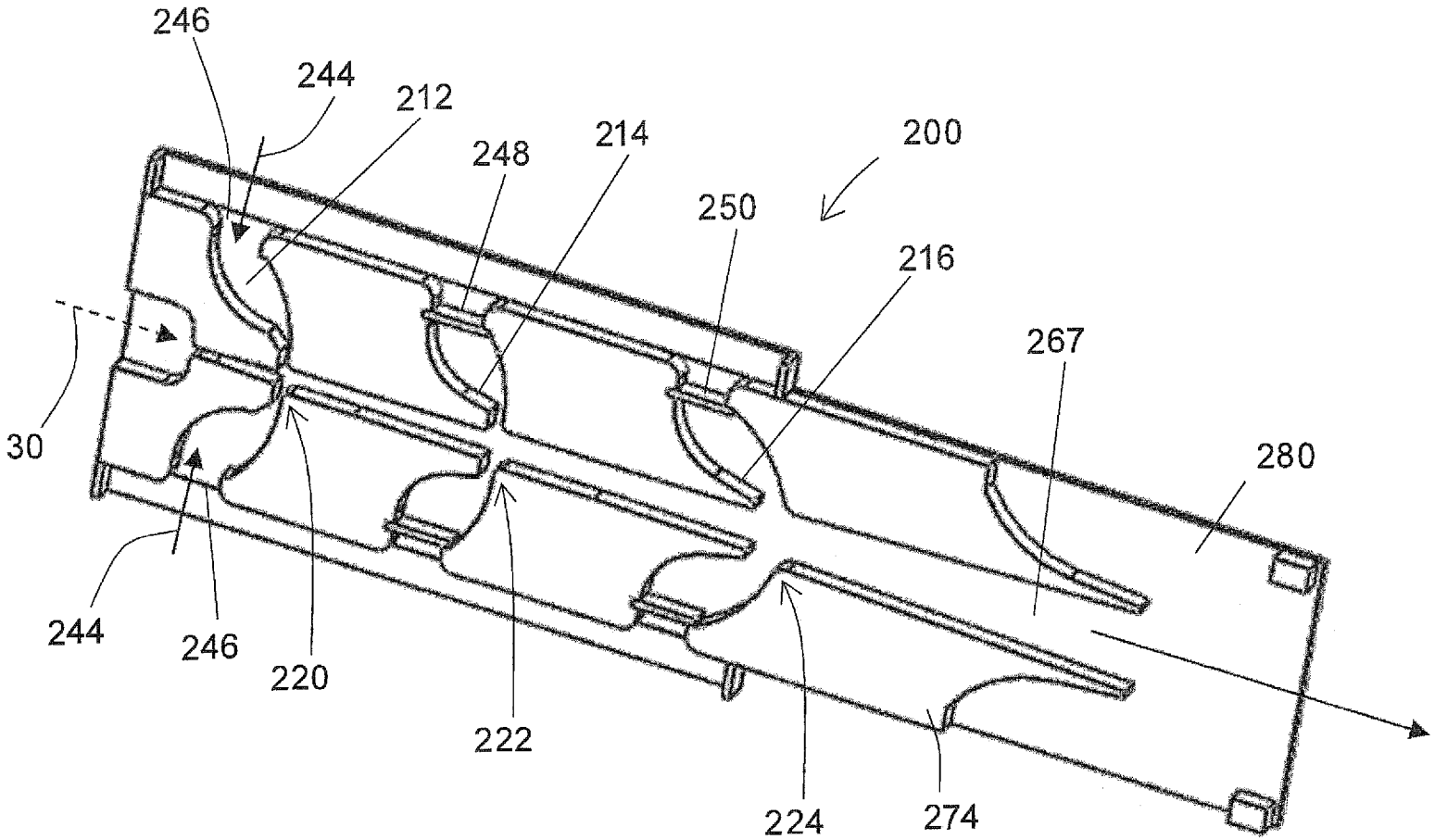
FIG. 6 is a schematic illustration of a multistage ejector with planar venturi nozzles and three suction stages.

FIG. 6 shows a schematic illustration of a multistage ejector, generally designated by reference numeral 200. In the following description, parts corresponding with those in FIG. 4 will be identified, where appropriate for the understanding of the invention, by corresponding reference numerals each increased by "100". The ejector 200 includes planar venturi nozzles 220, 222, 224 and three suction stages 212, 214, 216, with the suction ports 246 and the flap valves 248, 250 extending in a plane of nozzle plate 274 in which plane the venturi nozzles 220, 222, 224 are situated. The flap valves 248, 250 are shown here in a closed position. The flap valves 248, 250 may be provided on a separate plate 280 or integrated in the suction stages 214, 216, e.g. in respective grooves 290, as indicated in FIG. 7.

In the illustration of FIG. 6, the suction ports 246 and the flap valves 248, 250 extend perpendicular to a plane of the venturi nozzles 220, 222, 224, and the flap valves 248, 250 assume their closed position.

Compressed air is introduced in a direction of arrow 30 to draw in suction air that enters the multistage ejector 200 via ports 246, as indicated by arrows 244. The suction air exits together with compressed air through outlet channel 267. The flap valves 248, 250 open at a certain negative pressure and close the suction port 246 again when the vacuum flow falls below a threshold value.

Figure 7:
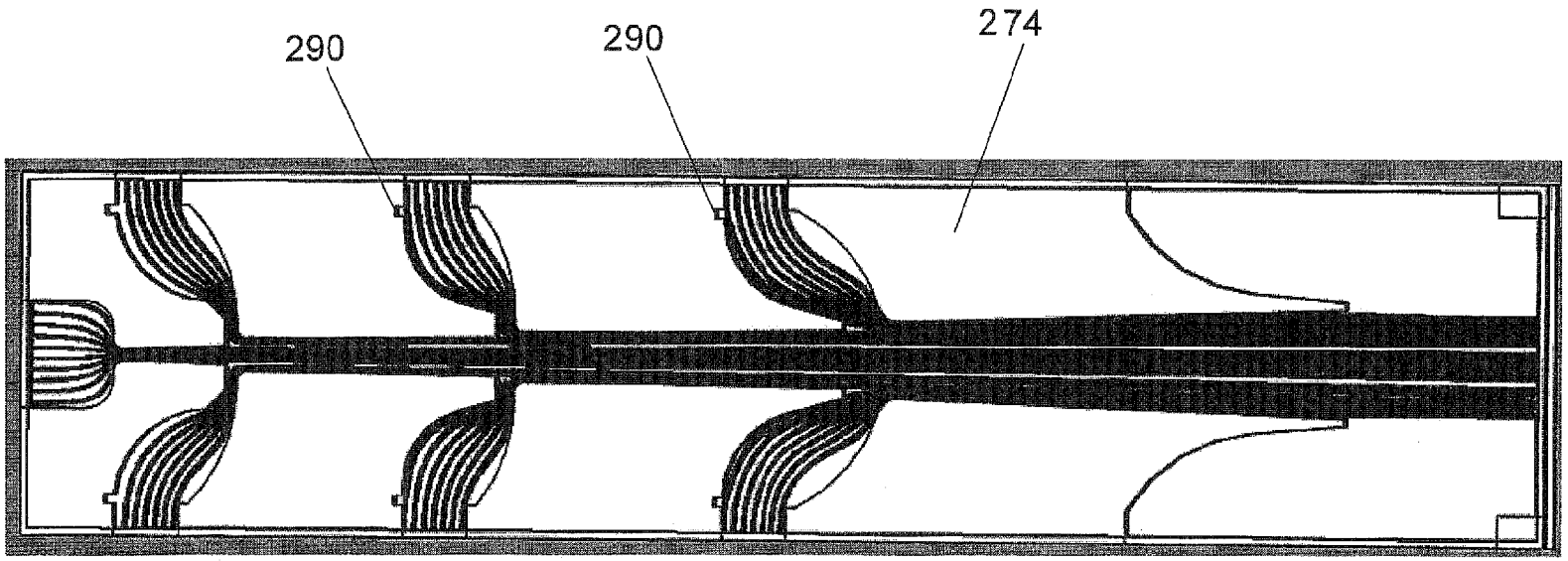
FIG. 7 shows a sketch of the multistage ejector of FIG. 6 with illustration of flow lines calculated by flow simulation.

FIG. 7 illustrates the flow pattern of compressed air and suction air, when the flap valves 248, 250 are open. The flow lines have been determined through flow simulation. The nozzle plate 274 may also be punched or made by laser. The nozzle plate 274 may also be cut by water jet application or by using coated EDM wires to prevent the formation or burrs. The structure of the multistage ejector 200 is even flatter in this embodiment. As a result of the rectangular cross section of the venturi nozzles 220, 222, 224, the nozzle plate 274 can be covered by simple boards.

While the invention has been illustrated and described in connection with currently preferred embodiments shown and described in detail, it is not intended to be limited to the details shown since various modifications and structural changes may be made without departing in any way from the spirit and scope of the present invention. The embodiments were chosen and described in order to explain the principles of the invention and practical application to thereby enable a person skilled in the art to best utilize the invention and various embodiments with various modifications as are suited to the particular use contemplated.

What is claimed as new and desired to be protected by Letters Patents is set forth in the appended claims and includes equivalents of the elements recited therein.

What is claimed is:

1. A pneumatic vacuum generator, comprising:

a top plate;

a nozzle plate disposed beneath the top plate and having at least one planar venturi nozzle having a flow cross section which deviates from a circularity;

a support plate placed beneath the nozzle plate and configured for support of a flap valve;

a first plate having the flap valve, a second plate disposed beneath the first plate;

a perforated plate; and a frame abutting an underside of the second plate and sandwiched between the second plate and the perforated plate to form a suction chamber.

2. The vacuum generator of claim 1, wherein the venturi nozzle has a substantial rectangular flow cross section.

3. The vacuum generator of claim 1, wherein the venturi nozzle has an oval flow cross section.

4. The vacuum generator of claim 1, wherein the venturi nozzle has an elliptical flow cross section.

5. The vacuum generator of claim 1, wherein the flap valve is disposed in parallel relation to a plane of the venturi nozzle for closing a suction cross section.

6. The vacuum generator of claim 1, wherein two of said venturi nozzles are arranged behind one another in flow direction.

7. The vacuum generator of claim 6, wherein the two venturi nozzles define an upstream venturi nozzle and a downstream venturi nozzle, wherein an outgoing air flow from an outlet of the upstream venturi nozzle constitutes a propellant air flow for an inlet of the downstream venturi nozzle.

8. The vacuum generator of claim 7, wherein the flow cross section of the downstream venturi nozzle is greater than a flow cross section of the upstream venturi nozzle.

9. The vacuum generator of claim 1, wherein the venturi nozzle has a rectangular configuration for operation of a vacuum gripper.

10. The vacuum generator of claim 1, wherein the venturi nozzle has a housing with a rectangular outer cross section.

* * * * *